United States Patent [19]

Boulanger et al.

[11] 4,296,287

[45] Oct. 20, 1981

[54] WEATHERPROOFED CONDITION RESPONSIVE SWITCH

[75] Inventors: Henry J. Boulanger, Cumberland, R.I.; Victor Lowell, North Attleboro; Elliot Whipple, Attleboro, both of Mass.

[73] Assignee: Texas Instruments Incorporated, Dallas, Tex.

[21] Appl. No.: 97,018

[22] Filed: Nov. 23, 1979

[51] Int. Cl.[3] ..... H01H 35/34

[52] U.S. Cl. ..... 200/83 P; 92/78; 200/83 S; 200/302

[58] Field of Search ..... 92/78, 101; 200/83 P, 200/83 S, 83 Y, 83 W, 83 J, 302

[56] References Cited

U.S. PATENT DOCUMENTS

| | | | |
|---|---|---|---|
| 2,629,543 | 2/1953 | Maniscalco | 92/78 |
| 2,685,650 | 8/1954 | Collins | 200/83 W |
| 2,844,305 | 7/1958 | Becht | 92/78 |
| 2,973,833 | 3/1961 | Cook | 92/78 |
| 2,985,358 | 5/1961 | Lee | 92/78 |
| 3,584,168 | 6/1971 | Halpert | 200/83 S |
| 3,816,685 | 6/1974 | Fiore | 200/83 S |
| 3,864,537 | 2/1975 | Fiore | 200/83 S |
| 4,037,317 | 7/1977 | Bauer | 200/83 S |

*Primary Examiner*—Gerald P. Tolin

*Attorney, Agent, or Firm*—John A. Haug; James P. McAndrews; Melvin Sharp

[57] ABSTRACT

An electric switch actuated in response to a condition, such as the occurrence of a particular pressure level, is shown to comprise a base having a switch receiving chamber and having an open end closed by a snap-acting diaphragm assembly. A motion transfer pin is slidably mounted between the diaphragm and a movable contact arm to transfer motion from the diaphragm to the arm. The diaphragm is supported on an annular plate used to prevent over pressures from deleteriously effecting the diaphragm and may be used in forming and calibrating the diaphragm for snapping in one direction. An adjustable spring is disposed on the other side of the diaphragm to permit calibration adjustment of the diaphragm for snapping in the opposite direction. The spring is mounted in a housing adapted to be connected to a pressure source. The switch is weatherproofed by providing a skirt which depends from the housing and extends toward and beyond the base. The space between the skirt and the base and components associated therewith is filled with potting material. An orifice is formed in the bottom wall of the base and a porous plug of sintered powdered metal is received in the orifice and projects out beyond the potting to permit pressure equalization between ambient and within the chamber.

13 Claims, 2 Drawing Figures

WEATHERPROOFED CONDITION RESPONSIVE SWITCH

This invention relates generally to condition responsive apparatus and in particular with regard to certain more specific features to pressure responsive devices adapted for actuation of electrical switches.

Such switches conventionally employ a flexible diaphragm as the pressure sensing element. The diaphragm is mounted in a housing which is adapted to be connected to a pressure source. When the pressure exposed to a face of the diaphragm reaches a selected level the diaphragm is caused to move and actuate a switch disposed on the other side of the diaphragm. An example of such a switch may be found in U.S. Pat. No. 3,584,168 which issued June 8, 1971, and is assigned to the assignee of the instant invention. As described in that patent a cup shaped base having an open end mount therein an electrical switch assembly comprising a stationary electrical contact and a movable electrical contact mounted on the free end portion of a flexible, cantilever mounted arm. A snap-acting diaphragm sealingly closes the open end of the base with a slidably mounted motion transfer pin located to transfer motion from the diaphragm to the movable contact arm. A housing having a threaded fitting is placed on the opposite side of the diaphragm to facilitate connection to a pressure source. Thus when a selected pressure level is reached, the diaphragm snaps from one configuration to another, i.e. from a convex to a concave configuration or vice versa. This snapping motion is transferred to the movable contact arm causing actuation of the electrical switch.

The switch described above is very effective and is widely used. However, a problem has developed when the switch is used in certain applications. That is, where the switch is used in applications in which the switch is exposed to weather special precautions frequently have to be taken to weatherproof the electrical switch portion of the device. By way of example, in certain industrial applications and in off-road vehicles including construction and farm vehicles the electrical switch portion must be sealed from the environment to prevent entry of moisture and other contaminants such as dirt and oil. Typically this is accomplished by providing an overmold for the electrical switch portion of the device. An enclosure is formed about the switch housing which is infilled with a suitable electrically insulative epoxy so that all the spaces leading into the housing are effectively sealed with only the terminals projecting from the epoxy to permit electrical connection to the switch. These switches frequently are subjected to wide temperature variations, for instance from −40° F. to 300° F. Since the switch chamber is sealed from the environment this temperature variation in accordance with the thermal equation of state, can cause change in pressure in the switch chamber in excess of 9 psi thereby causing a shift in the operating pressure on both actuation and deactuation.

It is an object of the present invention to provide a pressure responsive switch which is weatherproof yet is not subject to changes in actuation and deactuation operating pressure levels due to changes in ambient temperature.

It is another object of the present invention to provide an inexpensive yet reliable condition responsive switch construction which can be weatherproofed without affecting calibration of the device.

Other objects, advantages and details of the novel and improved condition responsive switch of this invention appear in the following detailed description of the preferred embodiment of the invention, the detailed description referring to the drawings in which.

Figure 1:
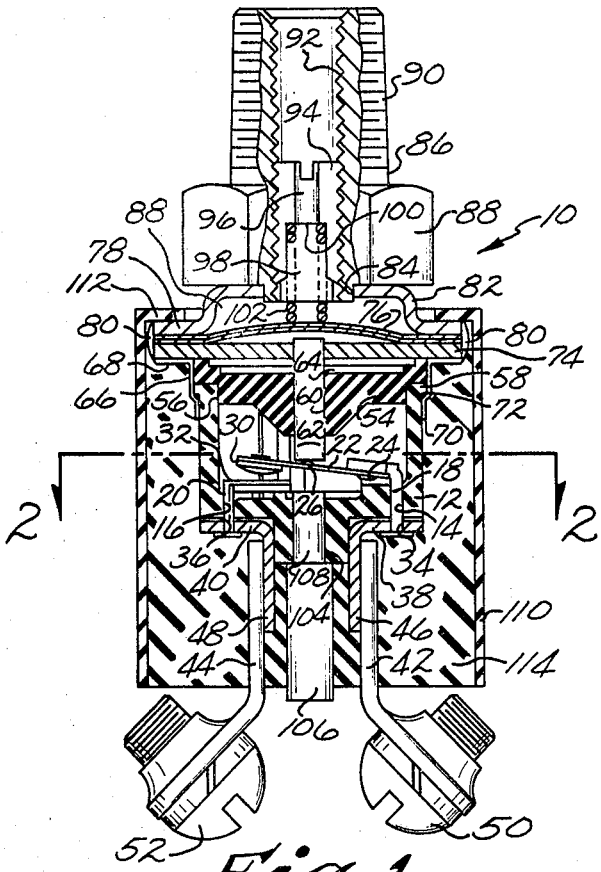
FIG. 1 is a cross sectional front elevational view of a device made in accordance with the invention.
Figure 2:
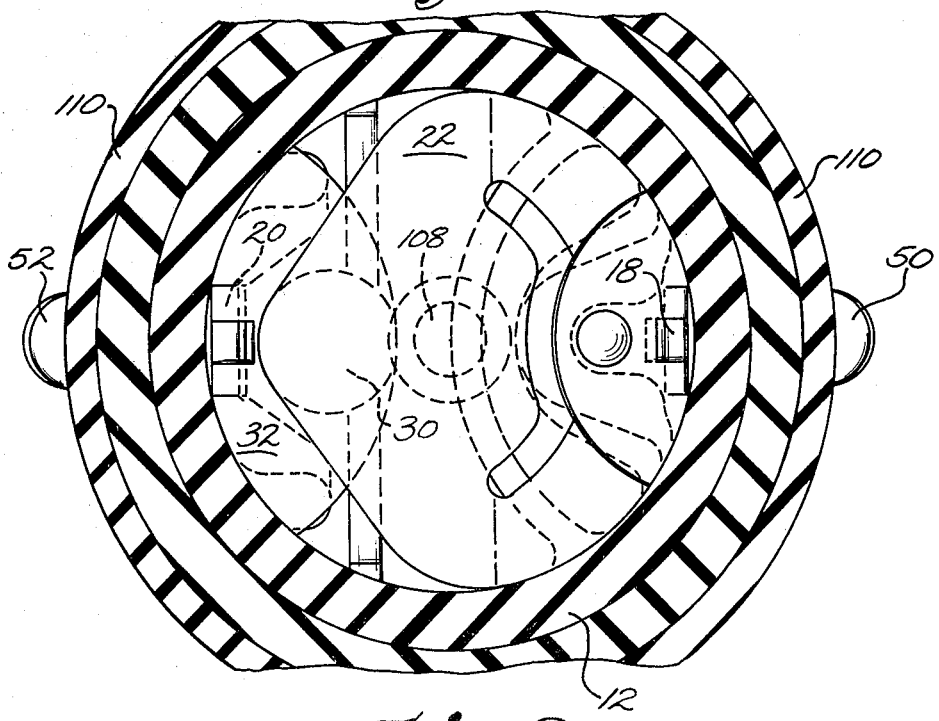
FIG. 2 is a cross sectional view taken on line 2—2 of FIG. 1.

In accordance with the invention, a condition responsive device, such as a pressure switch, has a condition sensing element, such as a flexible snap acting diaphragm separating two chambers from one another. In the case of a pressure switch one chamber is adapted to be attached to a pressure source while the other chamber is used to house a switching mechanism. The chamber housing the switching mechanism is provided with a seal of potting material in order to weatherproof the switching mechanism from the environment. A plug of sintered powdered metal expands from within the switch chamber to a point outside the potting material to permit pressure equalization between the switch chamber and the environment without permitting entry of moisture of other contaminants.

Condition responsive device 10 comprises a cylindrical cup shaped member 12 formed of a conventional electrically insulative, molded phenolic material and is formed with apertures 14, 16 for reception therein of support member 18 and stationary contact member 20 respectively. A movable contact arm 22 of electrically conductive material having good spring characteristics, such as beryllium copper, is cantilever mounted to support member 18 as by riveting at 24. Arm 22 is formed with a dimple 26, for a purpose to be described below, and mounts on its free end movable contact 30.

To improve electrical conductivity while minimizing additional expense, stationary contact 20, which also serves as part of the terminal structure, is preferably provided with a layer 32 of highly conductive material, such as a silver alloy. The outer ends of support 18 and stationary contact 20 pass through apertures 34, 36 of L-shaped members 38, 40 respectively, and are headed over to firmly lock the contact assembly in the housing and to provide electrical connection to the switch through terminal members 42, 44 which are respectively attached to legs 46, 48 of L-shaped members 38, 40 in any suitable manner, as by welding. Screws 50, 52 are received in a threaded aperture at the free distal end of respective terminal members 42, 44 to facilitate connection to suitable electrical leads.

A disc 54, generally plate-shaped of electrically insulative material is formed with a seating groove 56 about its periphery and is received on the distal portion of wall 58 of base 12. Disc 54 slidably mounts in a centrally located bore 60 a motion transfer pin 62 of electrically insulative material, such as a ceramic or glass material, and electrically isolates the electrical switch from the diaphragm area to be described below. Pin 62 contacts dimple 26 in movable arm 22 to enhance smooth transfer of motion from pin 62 to movable arm 22.

A cavity 64 is formed by recessing disc 54 to provide clearance for diaphragm 76 to snap from the position shown to the opposite configuration, and for calibrationstop element 74.

Tubular member 66 which may be formed of a conventional metallic material, is formed with a radially outwardly extending flange 68 and is placed over the distal wall 58 of base 12 and attached thereto, as by crimping, at 70. It will be noted that a small flange 72 is provided on distal wall 58 to facilitate locking of the tubular member 66 to base 12. Mounted on flange 68 are calibrationstop member 74, imperforate circular diaphragm member 76 and cover 78, all hermetically secured at their periphery, as by welding at 80. Cover 78 is dished out at 82 to provide a cavity 88 sealed by diaphragm 76 and is provided with bore 84 for reception therein of a port fitting 86 which is hermetically attached thereto. Port fitting 86 permits attachment to a pressure source for which monitoring is desired.

Port fitting 86 is provided with a hexagonal portion 88 and is threaded at one end 90 to facilitate attachment to an appropriate fitting. An axially extending, threaded bore 92 is formed in port fitting 86 with a threaded plug 94 received therein. An axially extending bore 96 is formed in plug 94 to permit passage of pressure medium therethrough. Bore 96 is enlarged at 98 to form a spring seat 100. A coil spring 102 is disposed in the enlarged bore 98 and extends from seat 100 to the top surface of diaphragm 76. Plug 94 is adjustably positioned in bore 92 to calibrate the device as described below.

Diaphragm 76 is shown as a bimetallic member but can also be formed of a monometallic member such as stainless steel. This diaphragm is formed into a snap-acting disc by means known in the art; basically, it involves forming a domed surface by plastically deforming the disc.

The device is partly assembled by hermetically attaching cover 78, diaphragm 76, calibration-stop member 74 and tubular member 66 together as by welding about their periphery as described above, with port fitting 86 mounted on cover 78 as by brazing or resistance welding.

Pressure may be introduced through fitting 86 to snap the diaphragm from the convex position shown in FIG. 1 to an opposite concave configuration and actually deform the calibration-stop member a selected amount. This would serve to increase the differential by lowering the pressure at which the diaphragm will snap back to its original position. On the other hand, if it is desired to narrow the differential, i.e., increase the amount of pressure at which the diaphragm will snap back to its original position, a force may be exerted against the side of member 74 remote from the diaphragm (as by a tool) to deform it toward the diaphragm.

The pressure exerted on the diaphragm to effect calibration is far greater than the pressure which the diaphragm will be subjected to during operation of the device so that member 74 during operation also effectively acts as a stop member preventing a change in calibration of the diaphragm.

Calibration of the pressure at which diaphragm 76 snaps from the position shown can be effectively adjusted by means of threaded plug member 94 which adjusts the spring bias placed on diaphragm 76 through spring 102.

During normal operation of the device the diaphragm snaps from the convex position shown in the figure to the opposite concave curvature when a predetermined amount of pressure is introduced into chamber 88 through port fitting 86.

An orifice 104, which may be circular in cross section is formed in the bottom wall of cup shaped member 12 and extends therethrough into the switch chamber. A plug 108 is received in orifice 104 essentially occupying all of the cross sectional area of the orifice. Plug 108 is formed with an elongated portion 106, preferably having a larger diameter than the portion received in orifice 104, and extends a selected distance below the bottom wall of member 12. Plug 108 is formed of powdered metal which is compressed to less than one hundred percent density allowing continuous microscopic passages throughout the plug. The metal may be sintered, glued or otherwise held together to provide such passages to allow equalization of pressure between the ambient in which device 10 is located and the space below diaphragm 76 i.e., the switch chamber and recess 64. Preferably stainless steel is used for the powdered metal with an average vent dimension between particles of from approximately one half to two microns which, it has been found, permits pressure equlization without allowing entry of liquid or particular undesirable contaminants. If desired other relatively non corrosive materials could be employed for the powdered materials such as brass or certain plastics such as phenolic.

A generally cylindrical skirt 110 formed of electrically insulative material, having an annular flange portion 112 is fitted over base 12 with flange 112 disposed on cover 78. Skirt 110 extends beyond base 12 with only terminal members 42, 44 and an end portion 106 of plug 108 projecting beyond the skirt. The enclosure formed between skirt 110 and base 12 with its associated components is infilled with any suitable electrically insulative, potting material 114.

Thus the switch chamber is effectively sealed from the environment so that liquid and other contaminants cannot enter while allowing a pressure equalization between the switch chamber and the outside environment.

It is to be understood that the invention is not limited in its application to the details of construction and arrangement of parts illustrated in the accompanying drawings, since the invention is capable of other embodiments. Also it is to be understood that the phraseology or terminology employed is for the purpose of description and not of limitation.

We claim:

1. Condition responsive apparatus comprising a base having a chamber therein and an open end in communication with the chamber, a snap-acting diaphragm, mounting means for mounting the diaphragm over the open end of the base to seal the open end, a switching mechanism disposed in the chamber and operatively connected to the diaphragm, electrical terminal receiving apertures in the base extending from outside the base into the chamber, electrical terminal means disposed in each respective terminal receiving aperture, the terminals connected to the switching mechanism, an orifice in the base extending from outside the base into the chamber and pressure equalization means received in and occupying essentially all of the cross sectional area of the orifice whereby changes in pressure in an ambient in which the apparatus is disposed and the pressure within the chamber are able to equalize.

2. Apparatus according to claim 1 in which the pressure equalization means is a plug member composed of powdered metal.

3. Apparatus according to claim 2 in which the powdered metal is stainless steel.

4. Apparatus according to claim 1 further including a housing received over the diaphragm on the side of the diaphragm remote from the base, the housing adapted to be attached to a pressure source.

5. Apparatus according to claim 2 in which the powdered metal has an average vent dimension between particles of approximately one half of two microns.

6. Apparatus according to claim 2 in which the powdered metal is brass.

7. Apparatus according to claim 1 in which the pressure equalization means is a plug member of powdered plastic material.

8. Apparatus according to claim 2 in which an enclosure is formed about the base with potting material received in the enclosure with only the electrical terminals and a portion of the plug extending beyond the potting material.

9. Apparatus according to claim in which the plug is cylindrical and has an enlarged diameter section that extends from the surface of the base to a point beyond the potting material.

10. Apparatus according to claim 5 in which the orifice is cylindrical and the plug is rod shaped.

11. Condition responsive appartus comprising a generally cup shaped base having a bottom wall and a side wall depending therefrom, and forming a chamber therein, the side wall terminating at an open end, a motion transfer pin guide having a bore therethrough received at the open end of the base, a diaphragm assembly comprising a metallic annular diaphragm support plate disposed on the guide, a metallic diaphragm disposed on top of the support plate and a cup shaped metallic housing disposed on top of the diaphragm, the diaphragm support, diaphragm and housing welded together along a common, continuous outer peripheral margin, a motion transfer pin slidingly received in the guide and having two opposite ends, one end adapted to engage the diaphragm, a stationary electrical contact mounted in the base, a movable contact arm mounted in the base and adapted to move into and out of engagement with the stationary contact, the other end of the motion transfer pin adapted to engage the movable contact arm, terminal receiving apertures formed in a wall of the base, electrical terminal means received in the apertures and connected to the stationary contact and movable contact arm, an orifice extending through the bottom wall of the base and pressure equalization means received in and occupying essentially all of the cross sectional area of the orifice whereby changes in pressure in an ambient in which the apparatus is disposed and the pressure within the chamber are able to equalize.

12. Apparatus according to claim 11 in which the pressure equalization means is a plug member composed of sintered powdered metal.

13. Apparatus according to claim 11 further including a generally cylindrical skirt depending from the housing on the direction of the base and extending beyond the base, potting material filling the space between the base, terminal means and plug and the skirt with at least a portion of the plug projecting beyond the potting material.

* * * * *